US008026475B2

(12) United States Patent
Senko

(10) Patent No.: US 8,026,475 B2
(45) Date of Patent: Sep. 27, 2011

(54) METHOD AND APPARATUS FOR A DUAL GATE FOR A MASS SPECTROMETER

(75) Inventor: Michael W. Senko, Sunnyvale, CA (US)

(73) Assignee: Thermo Finnigan LLC, San Jose, CA (US)

( * ) Notice: Subject to any disclaimer, the term of this patent is extended or adjusted under 35 U.S.C. 154(b) by 560 days.

(21) Appl. No.: 12/194,429

(22) Filed: Aug. 19, 2008

(65) Prior Publication Data

US 2010/0044559 A1 Feb. 25, 2010

(51) Int. Cl.
*H01J 49/26* (2006.01)

(52) U.S. Cl. ..... 250/281; 250/282; 250/396 R

(58) Field of Classification Search ..... 250/281, 250/282, 286, 283, 288, 396 R, 397, 396 ML
See application file for complete search history.

(56) References Cited

U.S. PATENT DOCUMENTS

| | | | | |
|---|---|---|---|---|
| 4,445,038 | A * | 4/1984 | Spangler et al. | |
| 4,633,083 | A * | 12/1986 | Knorr et al. | |
| 5,880,466 | A * | 3/1999 | Benner | 250/281 |
| 6,489,610 | B1 * | 12/2002 | Barofsky et al. | |
| 7,211,794 | B2 * | 5/2007 | Malek et al. | |
| 2001/0030284 | A1 * | 10/2001 | Dresch et al. | 250/287 |
| 2003/0141449 | A1 * | 7/2003 | Wells et al. | |
| 2004/0108455 | A1 * | 6/2004 | Mordehai | |
| 2007/0114382 | A1 * | 5/2007 | Clemmer et al. | |
| 2007/0158543 | A1 * | 7/2007 | Clowers et al. | |
| 2007/0176091 | A1 * | 8/2007 | Lange et al. | |
| 2007/0176270 | A1 * | 8/2007 | Zuleta et al. | |
| 2007/0272875 | A1 * | 11/2007 | Frederick et al. | |
| 2007/0278396 | A1 * | 12/2007 | Wu | |
| 2007/0278397 | A1 * | 12/2007 | Bateman et al. | 250/286 |
| 2009/0095902 | A1 * | 4/2009 | Robinson et al. | 250/287 |
| 2010/0065738 | A1 * | 3/2010 | Bowdler | 250/283 |

FOREIGN PATENT DOCUMENTS

| | | | |
|---|---|---|---|
| WO | WO 94/01206 | A1 | 1/1994 |
| WO | WO 2006/129068 | A2 * | 12/2006 |
| WO | WO 2007/062303 | A2 * | 5/2007 |

OTHER PUBLICATIONS

Haberland et al., "Converting a Reflectron Time-of-Flight Mass Spectrometer into a Tandem Instrument," Rev. Sci. Instrum. 62 (10), Oct. 1991, pp. 2368-2371.

The International Bureau of WIPO (Nora Lindner); "International Preliminary Report on Patentability," mailed Mar. 3, 2011.

* cited by examiner

*Primary Examiner* — Robert Kim
*Assistant Examiner* — Nicole Ippolito Rausch
(74) *Attorney, Agent, or Firm* — Thomas F. Cooney

(57) ABSTRACT

An ion gate apparatus for controlling the transmission of ion pulses between an origin and a destination in a mass spectrometer is disclosed, comprising: a first split gate having a length $L_1$, comprising a first electrode portion; and a second electrode portion electrically insulated from the first electrode portion and separated from the first electrode portion so as to form a first aperture therebetween; a second split gate disposed adjacent to the first split gate at a distance d from the first split gate and having a length $L_2$, comprising a third electrode portion; and a fourth electrode portion electrically insulated from the third electrode portion and separated from the third electrode portion so as to form a second aperture therebetween; a first voltage source electrically connected to said first electrode portion and to said second electrode portion; a second voltage source electrically connected to said third electrode portion and to said fourth electrode portion; and a controller electrically connected to said first voltage source and to said second voltage source.

22 Claims, 10 Drawing Sheets

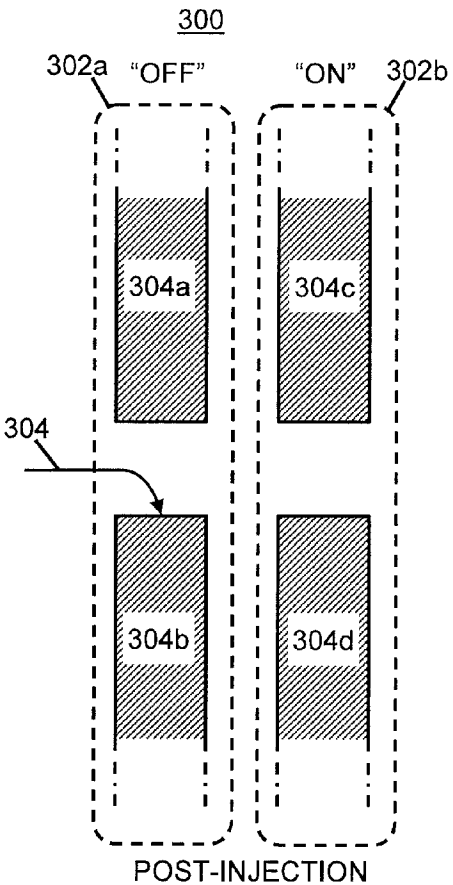
FIG. 5A
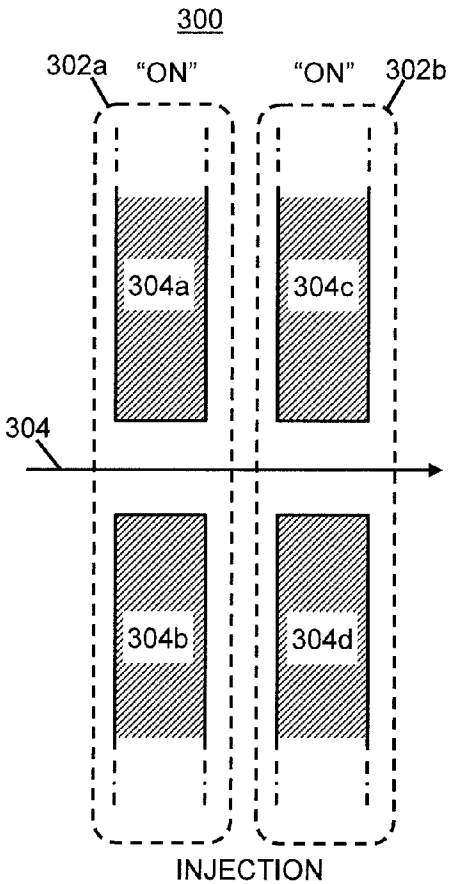
FIG. 5B
FIG. 5C

METHOD AND APPARATUS FOR A DUAL GATE FOR A MASS SPECTROMETER

FIELD OF THE INVENTION

Embodiments of the invention relate to a method and an apparatus of mass spectrometry, and, more particularly, to an ion gate method and an apparatus for controlling the transmission of ions from an origin to a destination within a mass spectrometer.

BACKGROUND

Mass spectrometers have been used to analyze a wide range of materials, including organic substances such as pharmaceutical compounds, environmental compounds and biomolecules. They are particularly useful, for example, for DNA and protein sequencing. In such applications, there is an ever increasing desire for high mass accuracy, as well as high resolution of analysis of sample ions by the mass spectrometer, notwithstanding the short time frame of modern separation techniques such as gas chromatography/mass spectrometry (GC/MS), liquid chromatography/mass spectrometry (LC/MS) and so forth.

Ion storage type mass analyzers, such as RF quadrupole ion trap, ICR (Ion Cyclotron Resonance), orbitrap, and FTICR (Fourier Transform Ion Cyclotron Resonance) mass analyzers, function by transferring generated ions via an ion optical means to the storage/trapping cells on the mass analyzer, where the ions are then analyzed. One of the major factors that limit the mass resolution, mass accuracy and the reproducibility in such devices is space charge, which can alter the storage, trapping conditions, or ability to mass analyze the contents of an ICR or ion trap, from one experiment to the next, and consequently vary the results attained.

Space charge effects arise from the influence of the electric fields of trapped ions upon each other. The combined or bulk charge of the final population of ions causes shifts in frequency and therefore m/z (i.e., dimensionless mass-to-charge ratio). At very high levels of space charge, the obtainable resolution will deteriorate and peaks close in frequency (m/z) can at least partially coalesce. A significant scan to scan variation in the magnitude of the space charge effect arises from differences in trapped ion density, caused by changes in the number of ions within the cell from one ionization/ion injection event to the next. Unless space charge is either taken into account or regulated, high mass accuracy, precision mass and intensity measurements can not be reliably achieved.

The flux of ions available for storage or trapping or mass analysis can depend on the type of ionization source employed. Different ion sources, including discontinuous and continuous types, can be used in conjunction with mass analyzers. Discontinuous ion sources generally provide discrete ion pulses or packets separated by periods when ionization events are absent or minimized. Common examples of such sources are the matrix assisted laser desorption ionization (MALDI) ion source, or the surface enhanced desorption ionization (SELDI) ion source, both of which use high-power pulsed lasers to desorb analyte molecules from a surface. A well-known and important example of a technique that produces an essentially continuous supply of ions is the electrospray ionization technique, in which singly or multiply charged ions in the gas phase are produced from a solution at atmospheric pressure.

In contrast to the potentially wide variability in ion flux delivered by ion sources, high-precision mass analyzers often require a fairly restricted range of ion population for optimal performance. If a too-small ion population is injected into the mass analyzer, it can be difficult to differentiate the detected population of ions from the noise level. Although increasing the population of ions in the analysis chamber of the mass analyzer can avoid this problem, too great an increase can lead to space charge problems as noted above, resulting in deterioration in m/z assignment accuracy. Thus, in general, the optimum performance of the ion trap mass analyzer is achieved when the ion population is characterized by maximum signal/noise ratio, but still is below the threshold of onset of significant space charge effects.

One way to improve the reproducibility of results, the mass resolution and accuracy in ion storage type devices is to control the ion population that is stored/trapped, or otherwise confined, and subsequently analyzed in the mass analyzer. Thus, ion gating techniques are generally used so as to control the total number of ions that enter an ion trap. For any particular flux of ions from a source, the so-called injection time, or time that the gate is "open" so as to allow ions to pass therethrough to a destination, may be chosen so as to allow a suitable total number of ions—for instance, 30000 ions—to pass through the gate to the destination. The destination may be an ion trap or, in fact, any apparatus capable of receiving, storing, measuring or otherwise handling ions, such as, for instance, a mass analyzer or an ion detector, an ion lens, an ion guide, etc.). Otherwise, the gate is "closed" so as to prevent ions from proceeding through to the destination.

FIGS. 1A-1B illustrate the construction and operation of a conventional ion gate 100. The conventional ion gate 100 comprises a first electrode portion 102*a* of length L and a second electrode portion 102*b*, also of length L, separated from one another so as to define an aperture 103. Ions provided by some origin 108, such as an ionization source, are accelerated in the direction of the gate 100 as ion beam 104. The ion gate 100 may be either maintained in an "ON" state, as illustrated in FIG. 1A, or, alternatively, in an "OFF" state, as illustrated in FIG. 1B, these terms being taken to mean, as used in this disclosure, that ions are permitted or are not permitted, respectively, to pass through the ion gate 100 towards a destination 110 on the opposite side of the gate from the origin.

FIG. 1A schematically illustrates ion trajectories with the ion gate 100 maintained in an ON state (or, more simply put, ion trajectories when the ion gate 100 is "ON"). When the ion gate is ON, both the first electrode portion 102*a* and the second electrode portion 102*b* are maintained at similar constant DC voltages. For simplicity of discussion, it is assumed, in the following discussion, that both electrode portions 102*a*-102*b* are maintained at the same voltage, $V_0$. Consequently, the ions originating from origin 108 pass through the aperture 103 in the gate as ion beam 105 and continue to move away from the opposite side of the gate towards the destination 110 as ion beam 106.

FIG. 1C schematically illustrates additional details of the passage of ion beam 105 through aperture 103 in ion gate 100. Since the ion beams 104-106 comprise ions having a range of m/z ratios and, since each ion has substantially identical kinetic energy to every other ion, relatively heavier ions travel more slowly through the aperture 103 than do relatively lighter ions of the same charge. FIG. 1C shows the trajectories of, for instance, two particular ions comprising the ion beam 105 and assumed to enter the aperture 103 at the same time, each ion having a charge of unity but one ion (i.e., the ion represented by trajectory 105*a*) having a mass number of 100 and the other ion (i.e., the ion represented by trajectory 105*b*) having a mass number of 1000. Although only two species are illustrated in FIG. 1C, the ion beam 105 will, in general, comprise many species having a range of m/z ratios. FIG. 1C shows that, in the time that the lighter ion just completely passes through the aperture 103, the heavier ion only travels approximately one-third of the distance through the aperture 103.

FIG. 1B schematically illustrates ion trajectories with the ion gate 100 maintained in an OFF state (or, more simply put, ion trajectories when the ion gate 100 is "OFF"). When the ion gate is OFF, the first electrode portion 102*a* is maintained at voltage $V_0$ and the second electrode portion 102*b* is maintained a voltage of $V_0+V_{off}$. The offset voltage $V_{off}$ may be either positive or negative. Assuming that $V_0$ is positive and that $V_{off}$ is negative, then, in this configuration, the positive ions comprising beam 105, including those particular ions represented by trajectories 105*a* and 105*b*, are deflected away from the first electrode portion 102*a* and are drawn toward the second electrode portion 102*b* in a fashion such that none of the ions pass through aperture 103 and whereby ions may, in fact, be neutralized at the second electrode portion 102*b*. The trajectories of negative ions would be reversed, such that the negative ions would be deflected away from the second electrode portion 102*b* and drawn towards and neutralized at the first electrode portion 102*a*. In this situation, ions are prevented from reaching the destination 110.

When the conventional ion gate 100 is switched from the OFF state, as shown in FIG. 1B, to the ON state, as shown in FIG. 1A, the greater velocity of relatively lighter ions will cause these to arrive at the destination 110 in advance of relatively heavier ions. More generally, assuming that all ions are initially allowed to proceed through gate 100 in the direction of destination 110 at the same time, those ions having a lesser value of the quantity m/z will arrive at the destination 110 in advance of those ions that have a greater value of m/z. When the ion gate 100 is switched in the reverse sense, from ON to OFF, the effect of ion mass will be much weaker in determining the time that ions stop arriving at destination 110, since virtually any deflection will prevent virtually all ions from proceeding to the destination 110, regardless of mass.

As a consequence of the principles described in the foregoing, the conventional gate 100 may lead to a sampling bias, wherein ions of low values of m/z are present at the destination in excess of their original abundance at the origin 108. It has been generally observed that this phenomenon is only problematical when the injection time (i.e., the time during which the gate is ON so as to permit a pulse of ions to pass) is so short that it approaches the flight time across the width of the gate.

FIG. 2 graphically depicts how the lag of ions having high values of m/z can cause anomalous mass spectrum measurements when the conventional ion gate is operated for short gate times. In FIG. 2, plots are given of calculations of the total number of ions detected for a situation in which an ion pulse is produced by passing an ion beam having equal concentrations of two species of ions—one having an m/z value equal to 100 and the other one having an m/z value equal to 1000. Curve 205*a* in FIG. 2 represents the calculated total number of ions having m/z equal to 100 that are detected (i.e., that are transmitted through the gate 100 to the destination 110, which in this case is a detector) plotted versus the injection time (the time that the gate is ON). Curve 205*b* is a similar plot representing the total number of ions having m/z equal to 1000 that are detected. Curve 208 in FIG. 2 is the ratio, $R_{1000/100}$, of the calculated values of the detected population of heavier-mass to lighter-mass ions, also plotted versus injection time. (Note that the leftmost vertical axis represents the number of ions that are detected, whereas the rightmost axis represents the ratio.) The time t=0, at the leftmost side of the plot, is the time that the gate is switched to the ON state. Any deviation of the ratio $R_{1000/100}$ from unity (denoted by a dashed horizontal line in FIG. 2) indicates a bias in the population of ions transmitted through the conventional ion gate 100. Although the ratio $R_{1000/100}$ approaches unity at long gate times, FIG. 2 shows that there is a significant under-representation of the heavier ions at gate times that are on the order of or less than the flight times of ions through the gate. This transmission bias in favor of lighter ions at short injection time periods has not been a significant restriction in the past, but as technological advances cause the ion sources to become "brighter", that is, a source of a greater ionic flux, the corresponding injection times decrease.

One way of implementing a brighter source in a mass spectrometer using electrospray ionization has been described in U.S. patent application Ser. No. 11/764,100 filed on Jun. 15 2007 and incorporated herein by reference in its entirety. In the aforementioned U.S. patent application Ser. No. 11/764,100, there is disclosed an improved means of ion transfer between the capillary and the skimmer through the provision, between the capillary and the skimmer, of a focusing device comprising a stacked ring radio-frequency (RF) ion guide with constant internal diameter. To assist in focusing ions at the exit of the stacked ring RF ion guide, either the spacing between rings is varied across the stack or the RF level is varied across the stack. Ions are moved towards the exit by means of either gas flow or an axial DC field. To prevent large clusters from flying through the focusing device, the stack can be bent such that there is no line of sight between the entrance and the exit. The focusing device may be constructed on a printed circuit board (constructed of either fiberglass or ceramic), because holes to support the electrodes can be drilled in the board at arbitrary positions to provide the variable ring spacing.

With improvements in source brightness such as discussed above, gating times need to be shortened so as to provide no more than an optimum quantity of ions to an ion trap device. One possibility for shortening the minimum gate period is to use a gate of shorter physical length. However, shorter length gates suffer the disadvantage of requiring greater voltage delivery to the electrodes in order to guarantee deflection of ions during the off period. Equivalently, ions could be moved across the gate faster using higher translational energies, but again this creates the disadvantageous situation in which larger voltages are required for acceleration as well as for complete deflection. Alternatively, the minimum time can be somewhat compensated for by adding the known or predictable flight time across the gate to the requested injection time. For example, if it is known that an ion takes 5 microseconds to cross the gate at a specified energy, then to provide 10 microseconds of ions, the gate must be held open for a total of 15 microseconds. Unfortunately, as noted above, the flight time across the gate is m/z dependent, and thus this simple compensation scheme only works for a single mass. Although such a compensation scheme would be suitable for mass spectrometry apparatuses or modes of operation in which only a single m/z is of concern during a particular gate period, such as selected ion monitoring (SIM) mass spectrometry or tandem mass spectrometry (sometimes referred to as MS/MS or $MS^n$), these are situations where short injection times are less likely because the ions of only a single or restricted range of m/z comprise only a small fraction of the ion flux or of the ion population maintained in a storage device in front of the mass analyzer. More often, short injection times are required during full scans where all of the ions are trapped.

From the foregoing discussions, it may be observed that there is a need in the art for improved ion gate apparatuses and methods that reduce the bias, relative to conventional ion gates, in the population of ionic masses transmitted therethrough.

BRIEF SUMMARY

Improved ion gate apparatuses for a mass spectrometer and methods for operating an ion gate apparatus are herein disclosed. According to embodiments in accordance with one aspect the invention, there is provided an ion gate apparatus for controlling the transmission of ion pulses between an origin and a destination in a mass spectrometer and that includes a first split gate comprising a first electrode portion and a second electrode portion separated from one another by a first aperture; a second split gate disposed adjacent to the first split gate and comprising a third electrode portion and a fourth electrode portion separated from one another by a second aperture, wherein the second split gate is separated from the first split gate by a distance d, wherein the time of flight of ions of the pulses across the distance d is less than the time of flight of said ions across each of the first and second split gates.

In some embodiments in accordance with the present invention, the distance d is set such that $d<L_1$ and $d<L_2$. In other embodiments in accordance with the present invention, the time of flight across the separation of distance d is controlled by applying an accelerating voltage in the direction of flight across the separation. Embodiments of the ion gate apparatus may further include one or more ion lenses disposed between the first and second split gates or after the second split gate. Embodiments of the ion gate apparatus may include a first voltage source electrically connected to the first and second electrode portions, a second voltage source electrically connected to the third and fourth electrode portions, and a controller for commanding the first and second voltage sources to timely apply voltages between the first and second electrode portions and between the third and fourth electrode portions.

According to embodiments in accordance with another aspect of the present invention, there are provided methods for operating an ion gate apparatus. Embodiments may include the steps of setting a first split gate to its ON state and setting a second split gate disposed adjacent to the first split gate to its OFF state; setting the second split gate to its ON state for a period of time corresponding to a predetermined injection time so as to permit transmission of an ion pulse through both split gates; and setting the first split gate to its OFF state so as to terminate the transmission. Embodiments may include the further steps of setting the second split gate to its OFF state and setting the first split gate to its ON state in preparation for potential transmission of another ion pulse.

BRIEF DESCRIPTION OF THE SEVERAL VIEWS OF THE DRAWING

The above noted and various other aspects of the present invention will become apparent from the following description which is given by way of example only and with reference to the accompanying drawings, not drawn to scale, in which:

FIG. 2 is a graph of calculations of the total number of ions of two different species with different respective m/z values that pass through the conventional ion gate and the ratio thereof plotted against the time that the gate is ON;

FIG. 5A is a schematic illustration of operation of an ion gate in accordance with a method of the present invention, showing operation prior to an ion injection period;

FIG. 5B is a schematic illustration of operation of an ion gate in accordance with a method of the present invention, showing operation during an ion injection period;

FIG. 5C is a schematic illustration of operation of an ion gate in accordance with a method of the present invention, showing operation subsequent to an ion injection period;

FIG. 6 is a graph of calculations of the total number of clean ions of two different species with different respective m/z values that pass through an ion gate in accordance with an embodiment of the present invention and the ratio thereof plotted against the time that the gate is ON.

DETAILED DESCRIPTION

This disclosure describes an improved ion gate apparatus. The following description is presented to enable any person skilled in the art to make and use the invention, and is provided in the context of a particular application and its requirements. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described.

To more particularly describe the features of the present invention, please refer to FIGS. 1A through 7 in conjunction with the discussion below.

Figure 1A:
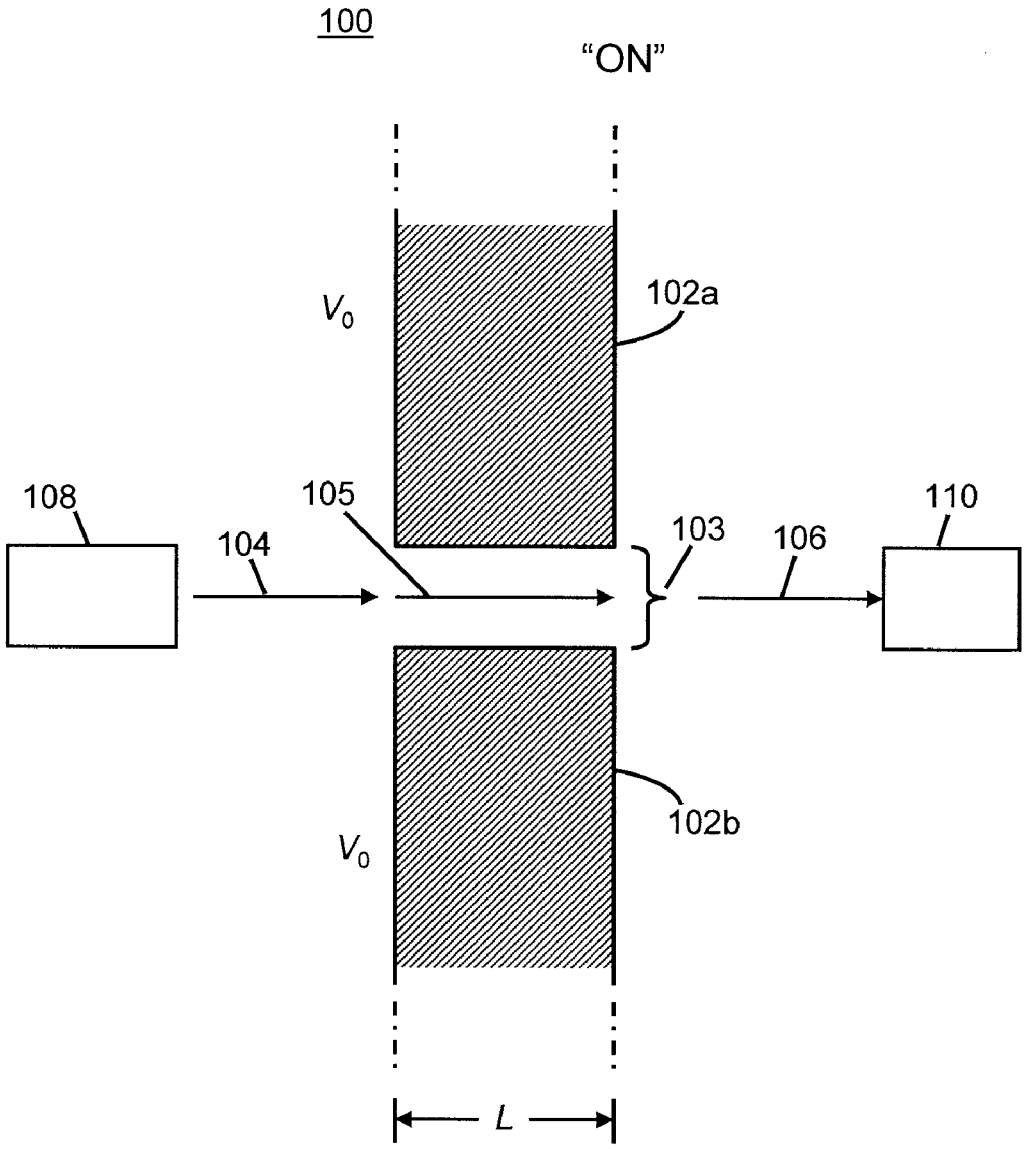
FIG. 1A is an illustration of a conventional ion gate maintained in an ON state.
Figure 1B:
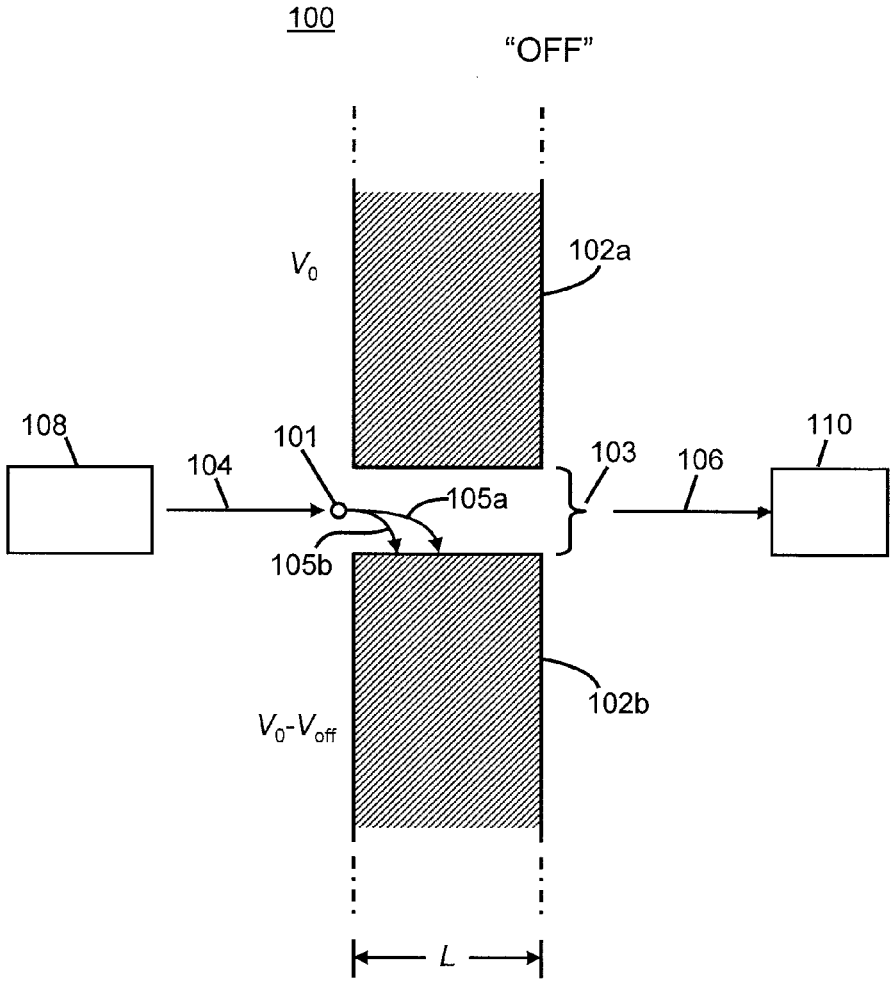
FIG. 1B an illustration of a conventional ion gate maintained in an OFF state and ion trajectories in the vicinity of the ion gate.
Figure 1C:
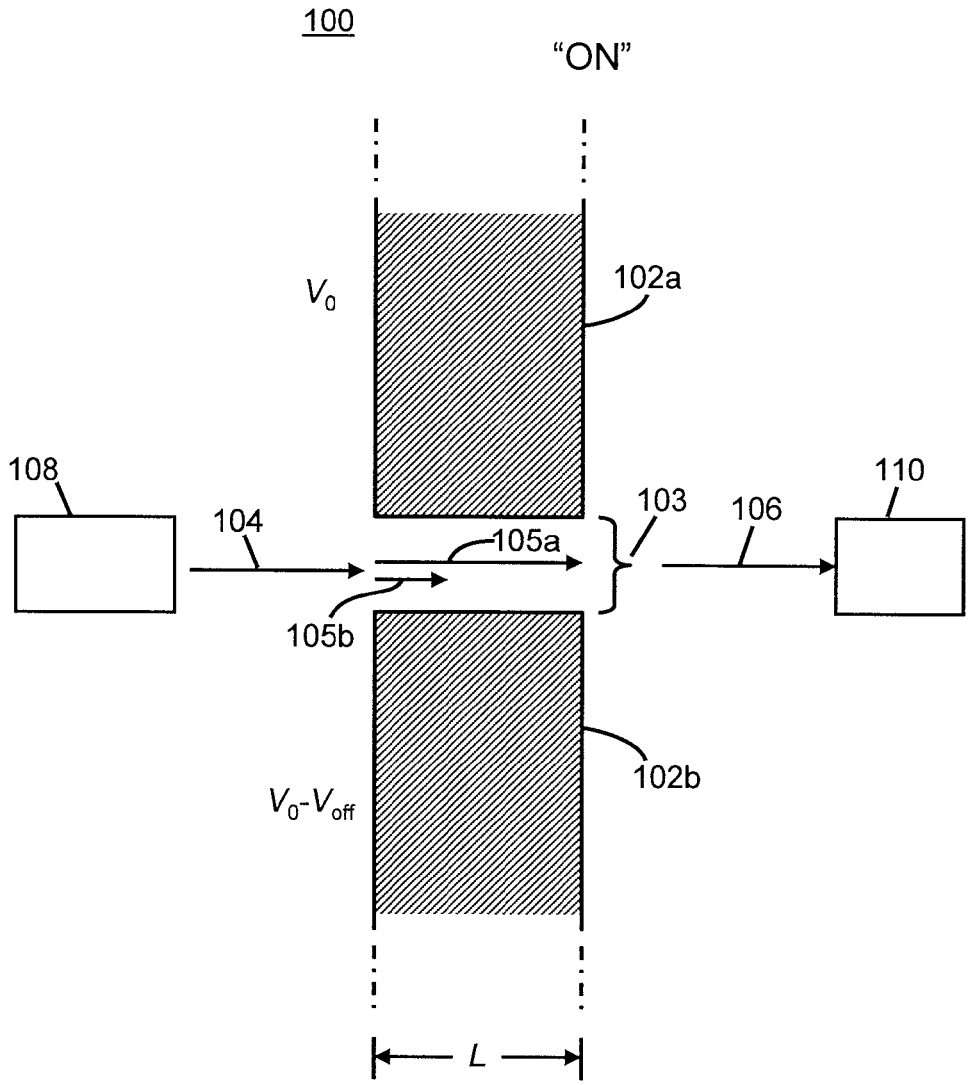
FIG. 1C is an illustration of a conventional ion gate maintained in an ON state, showing additional details of trajectories of ions having different m/z ratios.
Figure 2:
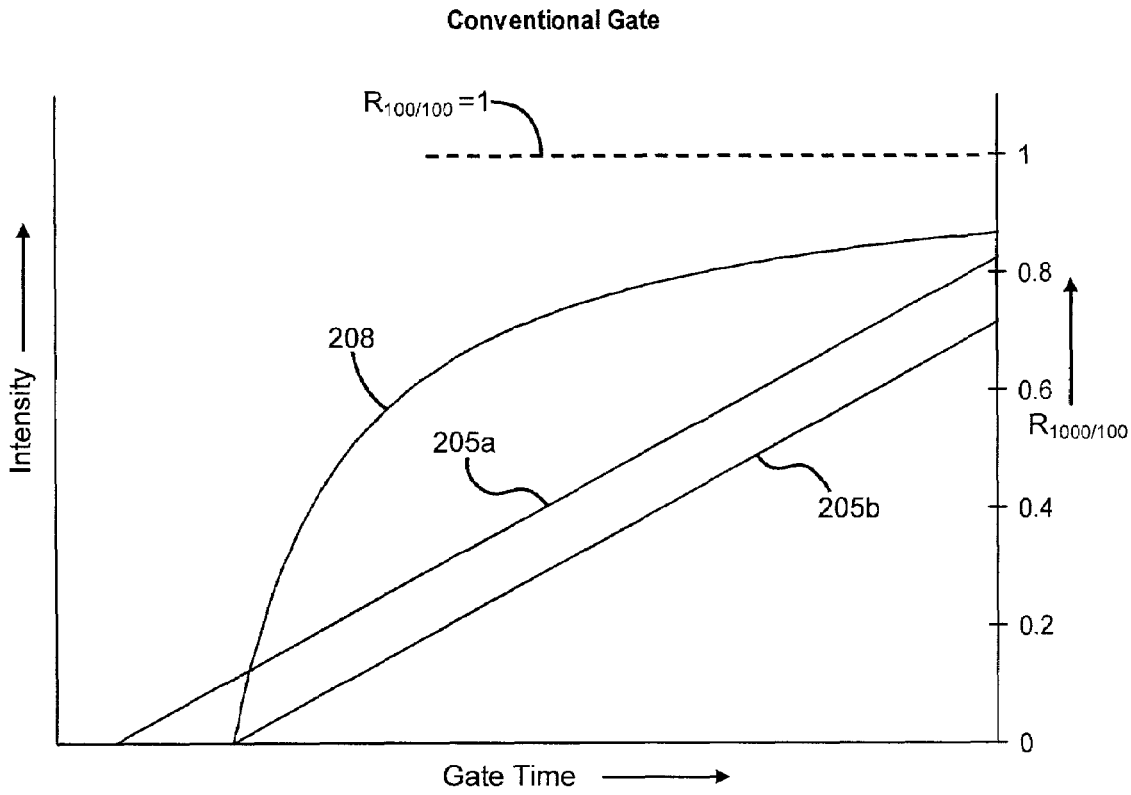
Figure 3:
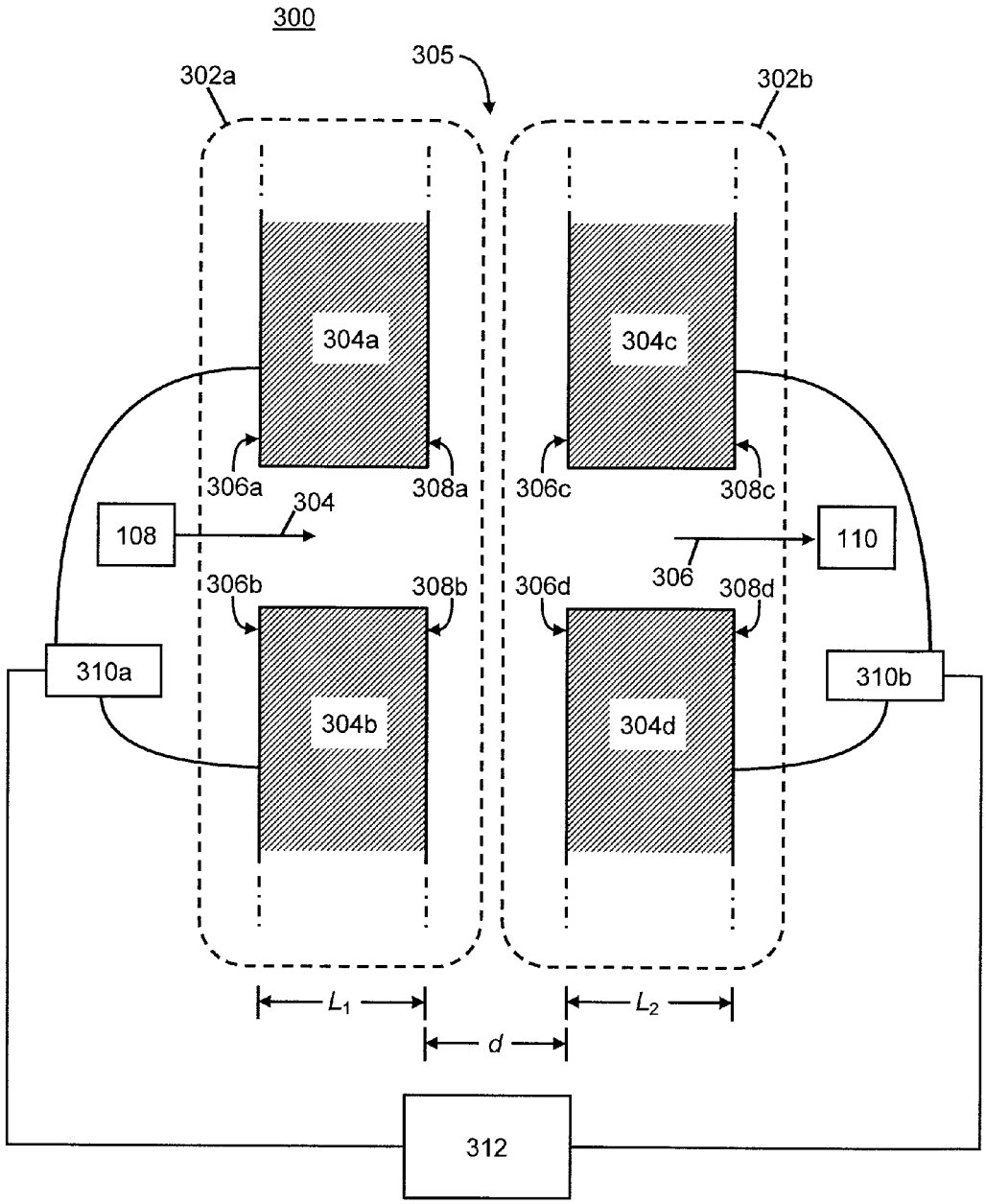
FIG. 3 is an illustration of a novel ion gate apparatus in accordance with an embodiment of the present invention.

FIG. 3 is a schematic illustration of an improved ion gate apparatus in accordance with an embodiment of the present invention. The apparatus 300 shown in FIG. 3 comprises a first split gate 302*a* and a second split gate 302*b* disposed adjacent to and in series with the first split gate (302*a*), the second split gate being disposed at a distance d from the first split gate so as to produce gap 305. In order to achieve a short ion flight time across the gap 305, the first and second split gates may be disposed such that $d<L_1$, or $d<L_2$ (or both) where $L_1$ and $L_2$ are the lengths of split gate 302*a* and split gate 302*b*, respectively, measured in the direction essentially parallel to the flight direction of ion beam 304. The first split gate 302*a* comprises a first electrode portion 304*a* and a second electrode portion 304*b*. Likewise, the second split gate 302*b* comprises another first electrode portion 304*c* and another second electrode portion 304*d*. Although the electrode portions are drawn as "flat" bars or plates in FIG. 3 and other figures of this document, these electrode portions need not be flat and may comprise an alternative shape, such as a curved shape.

Ions provided by some origin 108 are accelerated in the direction of the gate apparatus 300 as ion beam 304 (see FIG. 3). As discussed previously, the ion gate apparatus 300 may be either maintained in an "ON" state or, alternatively, in an "OFF" state. Further, each one of the split gates 302*a*-302*b* may be maintained its own individual ON or OFF state, the individual state (i.e., either ON or OFF) of the split gates being independently operable with respect to each other. In an ON state of the gate apparatus 300, ions may pass completely through the gate apparatus 300, in which case they pass through the first split gate 302*a*, the gap 305 and the second split gate 302*b* in sequence and then depart from the gate apparatus as ion beam 306 so as to reach a destination 110 on the opposite side of the gate from the origin 108 (FIG. 3). The source 108 and the destination 110 are not part of the ion gate apparatus 300 proper.

The first electrode portion 304*a* of the first split gate 302*a* comprises a front end 306*a* and a back end 308*a* as shown in FIG. 3, where it is to be noted that, in this document, the terms "front" and "back" refer to the condition of either facing or being opposite to the origin 108 respectively. Likewise, the second electrode portion 304*b* of the first split gate 302*a* comprises front end 306*b* and back end 308*b*. Likewise, the first electrode portion 304*c* of the second split gate 302*b* comprises front end 306*c* and back end 308*c* and the second electrode portion 304*d* of the second split gate 302*b* comprises front end 306*d* and back end 308*d*.

Each one of the split gates 302*a*-302*b* may be in its own individual state—either ON or OFF—independently of the other split gate. The state of each such split gate is controlled by applying voltages to its respective first and second electrode portions, similarly to the control of the conventional ion gate 100 previously discussed (FIG. 1). Accordingly, the apparatus further comprises a first voltage source 310*a* which applies voltages to or across the first electrode portion 304*a* and the second electrode portion 304*b* of the first split gate 302*a* as well as a second voltage source 310*b* which applies voltages to or across the first electrode portion 304*c* and the second electrode portion 304*d* of the second split gate independently of the first voltage source. Alternatively, the second electrode portion 304*b* of the first split gate 302*a* and the second electrode portion 304*d* of the second split gate 302*b* could be either physically or electrically connected to each other so as to together comprise a common electrode maintained at a common electrical potential, possibly ground potential.

A controller 312, such as digital computer or electronic processor or electronic controller board, commands or controls the magnitude and timing of voltages applied to or across the various electrode portions 304*a*-304*d* in a fashion such that the operation of the first split gate 302*a* and the second split gate 302*a* are coordinated so as to provide optimal transmission of ions through the gate apparatus 300 at the proper times, with appropriately short gating periods and without the need for increased electrode voltages relative to the conventional gate 100. This operation is described in greater detail below.

The origin 108 may be any location or apparatus from which ions comprising a range of m/z ratios are provided, such as, for instance, an ionization source at a sample, an ion mass filter, an ion trap that has been configured so as to release ions of a certain mass range, an ion lens, an ion guide, etc. The destination may be an ion trap or, in fact, any apparatus capable of receiving, storing, measuring or otherwise handling ions, such as, for instance, a mass analyzer or an ion detector, an ion lens, an ion guide, etc. In this document, it is assumed that ions are produced and accelerated in a fashion such that they all carry a positive charge and such that they all have essentially identical kinetic energies. Both such assumptions represent common situations in mass spectrometry.

Figure 4A:
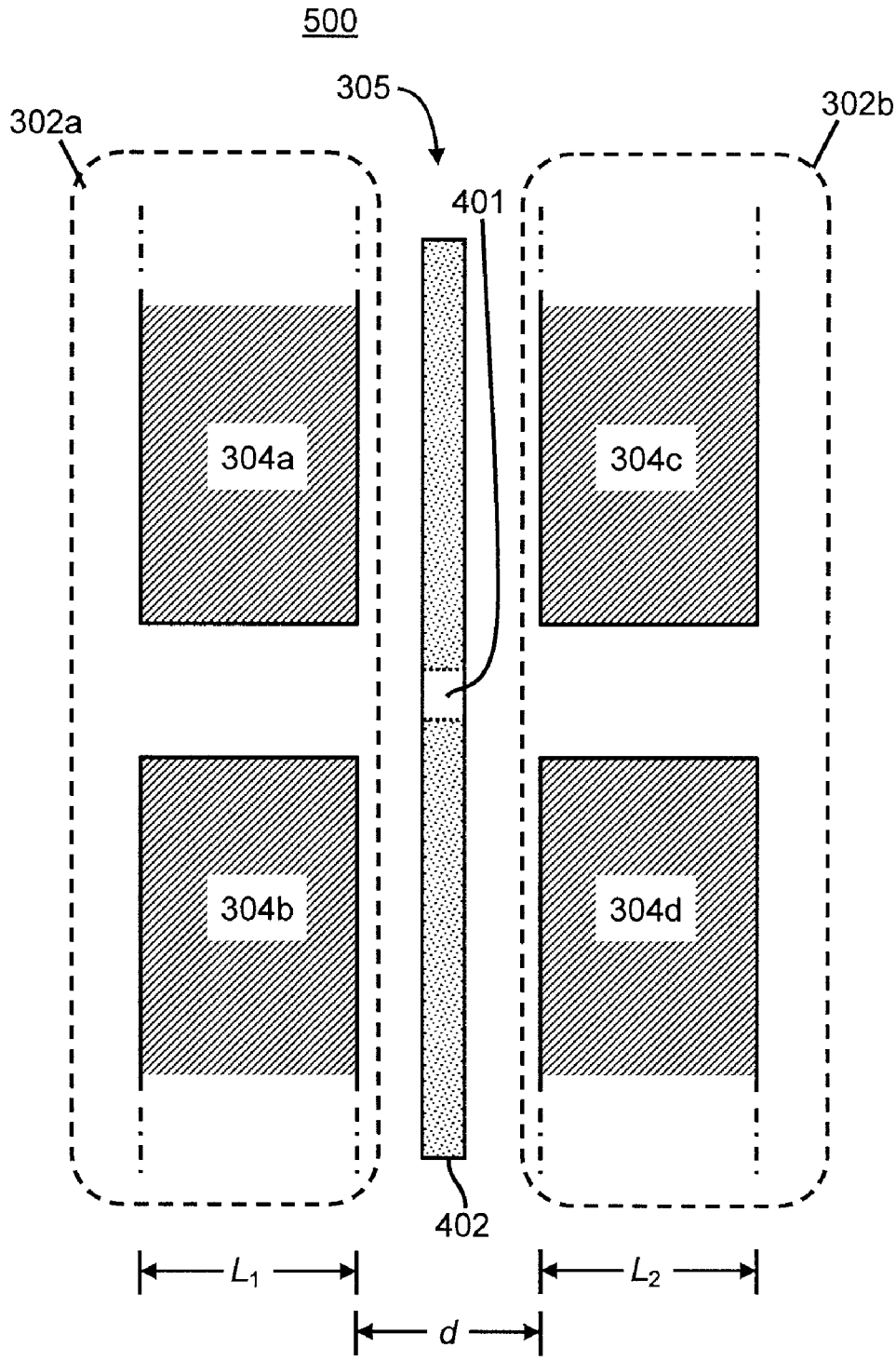
FIG. 4A is an illustration of another novel ion gate apparatus in accordance with an embodiment of the present invention.

FIG. 4A is a schematic illustration of another improved ion gate apparatus 500 in accordance with an embodiment of the present invention. The ion gate apparatus 500 comprises all the components previously described with reference to FIG. 3 and further comprises an ion lens 402 disposed within the gap 305 between first split gate 302*a* and the second split gate 302*b*. The ion lens includes an aperture 401 through which ions may pass. The ion lens 402 is a single electrode and may be electrically connected to a voltage source (not shown). In this way, the ion lens 402 may be maintained at one or more various DC voltages in order to minimize the effect of the electric field produced by each one of the split gates (302*a*-302*b*) on ions in the other gate. If there is limited space available within the gap 305, the lens 402 may be a flat plate lens.

Figure 4B:
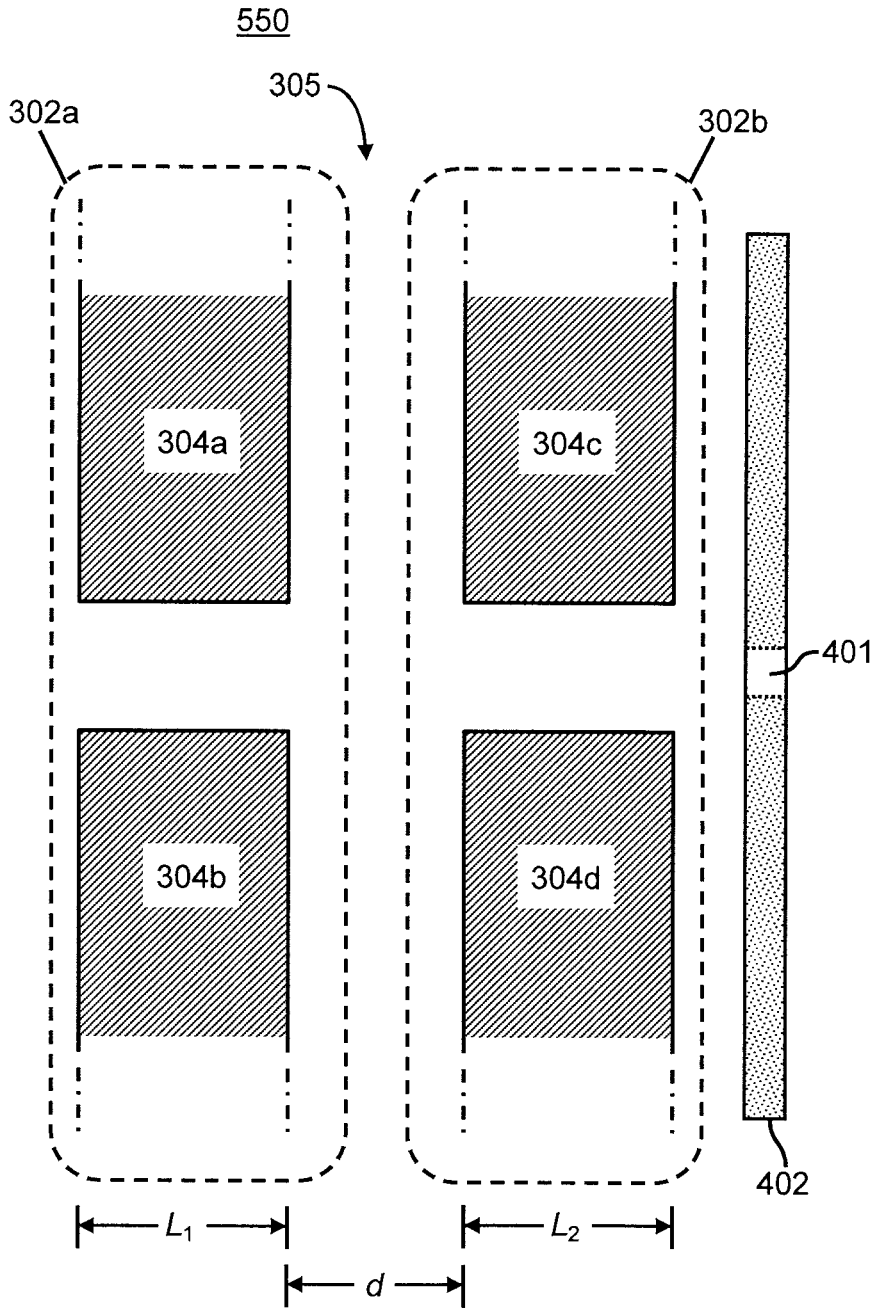
FIG. 4B is an illustration of yet another novel ion gate apparatus in accordance with an embodiment of the present invention.

FIG. 4B is a schematic illustration of another improved ion gate apparatus 550 in accordance with an embodiment of the present invention. The ion gate apparatus comprises all the components previously described with reference to FIG. 4A and all of these components are disposed similarly to the disposition already shown in FIG. 4A, except for the position of the ion lens 402. Within the ion gate apparatus 550 (FIG. 4B), the ion lens 402 is disposed at the back of the second split gate lens 302*b* and in front of the destination 110 instead of within the gap 305. In this position, the ion lens 402, when maintained at a voltage, can function to assist in directing any ion beams towards the destination 110 after their passage through the ion gate apparatus 550. Optionally, an additional ion lens may be disposed within the gap 305 (as previously described with reference to FIG. 4A) such that the ion gate apparatus comprises two ion lenses, one disposed within the gap 305 and one disposed at the back of the second split gate 302*b*. This alternative embodiment is not explicitly shown in the accompanying drawings. Either or both of such ion lenses may comprise a flat plate lens.

Now that various examples of apparatuses in accordance with embodiments of the invention have been illustrated and described, the operation of apparatuses in accordance with the invention is now discussed. The inventor has discovered that, when operated in accordance with the novel methods in accordance with the invention as described below, the minimum usable gate period is no longer tied specifically to the flight time of ions across a gate, as in the conventional gate 100, but is, instead, more directly related to the flight time between the gates, that is, across the gap 305 of width d (e.g., see FIG. 3). In other words, operation of apparatus or methods in accordance with the present invention cause the graphs of detected ions to no longer assume the forms shown in FIG. 2 but to, instead, exhibit a greater degree of linearity with much greater representation of heavier ions down to shorter injection times. Thus, the minimum usable gate period is on the order of the flight time of ions across the gap 305. Advantageously, the width d may be easily made much shorter than either of the lengths, $L_1$ and $L_2$, of the individual split gates, such as for instance, split gates 302*a* and 302*b*, thus enabling good representation of relatively heavy ions down to the level of one microsecond. Since there is no attempt to deflect the ions between the gates, this space limitation is restricted primarily by mechanical design constraints. Such mechanical design features are easier and more cost effective to implement than would be electronic measures. Alternatively, but less desirably, the flight time across the gap 305 may be made smaller by maintaining a wider gap while applying an acceleration voltage in the direction of flight.

An exemplary mode of operation of an ion gate apparatus in accordance with the present invention is illustrated in FIGS. 5A-5C. For ease of illustration and discussion, only the operation of the apparatus 300 (without an ion lens) is shown and discussed. The operation of other apparatuses in accordance with embodiments of the invention would be similar.

As illustrated in FIG. 5A, before an ion injection period, the first split gate 302*a* is in the ON state, while the second split gate is in the OFF state. As observed in FIG. 5A, this permits ion beam 304 to pass through the first split gate 302*a* and into the gap 305. However, on approach to the second split gate 302*b*, the ion beam 304 is deflected by the electric field created by the application of a voltage difference between the top electrode portion 304*c* and bottom electrode portion 304*d* of the second split gate 302*b*. Consequently, in this configuration, ions are neutralized at one of the electrode portions 304*c*-304*d*, depending on the sense of the voltage across the electrode portions, and no ions pass completely through the ion gate 300. Thus, the overall state of the ion gate apparatus is OFF.

Subsequently, as shown in FIG. 5B, during the ion injection period, the state of the first split gate does not change (i.e., the state remains ON), while the second split gate 302*b* is also placed into its ON state to allow transmission of the ion beam completely through the ion gate apparatus 300. Thus, in this configuration, the overall state of the ion gate apparatus is ON.

Subsequently, to conclude the injection period, the first ion gate 302*b* is placed into the OFF state. In this configuration, the ion beam 304 is deflected by the electric field caused by the application of a voltage difference between the top electrode portion 304*a* and bottom electrode portion 304*b* of the first split gate 302*a*. Consequently, in this configuration, ions are neutralized at one of the electrode portions 304*a*-304*b*, depending on the sense of the voltage across the electrode portions, and no ions pass completely through the ion gate 300. Thus, the overall state of the ion gate apparatus is once again OFF. The OFF state is defined when the first gate is turned off. The second gate can continue to be on for an indeterminate amount of time without effecting functionality, until it is time to recycle the apparatus back to its pre-injection configuration in preparation for a subsequent injection. To recycle the apparatus back to its pre-injection configuration, the second split gate 302*b* is placed into its OFF state (thus temporarily causing both of the split gates 302*a*-302*b* to simultaneously be in the OFF state) and then, the first split gate 302*a* is placed into its ON state.

The illustrations in FIGS. 5A-5C, show the deflection of the second split gate 302*b* to be in the same direction as the deflection of the first split gate 302*a*. However, the inventor has determined that the best operation is obtained by using opposed deflections in the two gates. One example of this operation occurs if, during the pre-injection period (FIG. 5A), the second split gate 302*b* deflects the ion beam 304 downwards, and during the post-injection period (FIG. 5C), the first split gate 302*a* deflects the ion beam upwards. The reason for the opposed deflections is that ions residing between the gates during an ON period will be deflected upward and downward by an almost equal amount. Of course, the use of the terms "downwards" and "upwards" in the foregoing discussion is for illustrative purposes only and is to be taken with respect to the drawing page; the use of such terms is not intended to imply any particular preferred orientation of the apparatus with respect to the surface of the earth.

Figure 6:
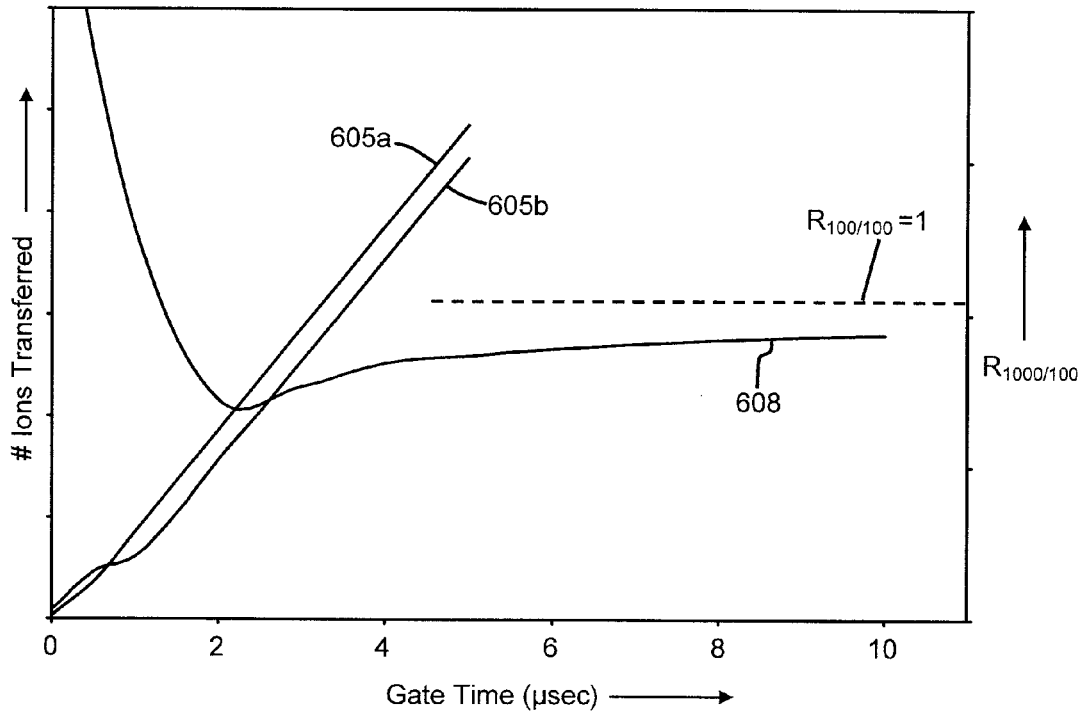
Figure 7:
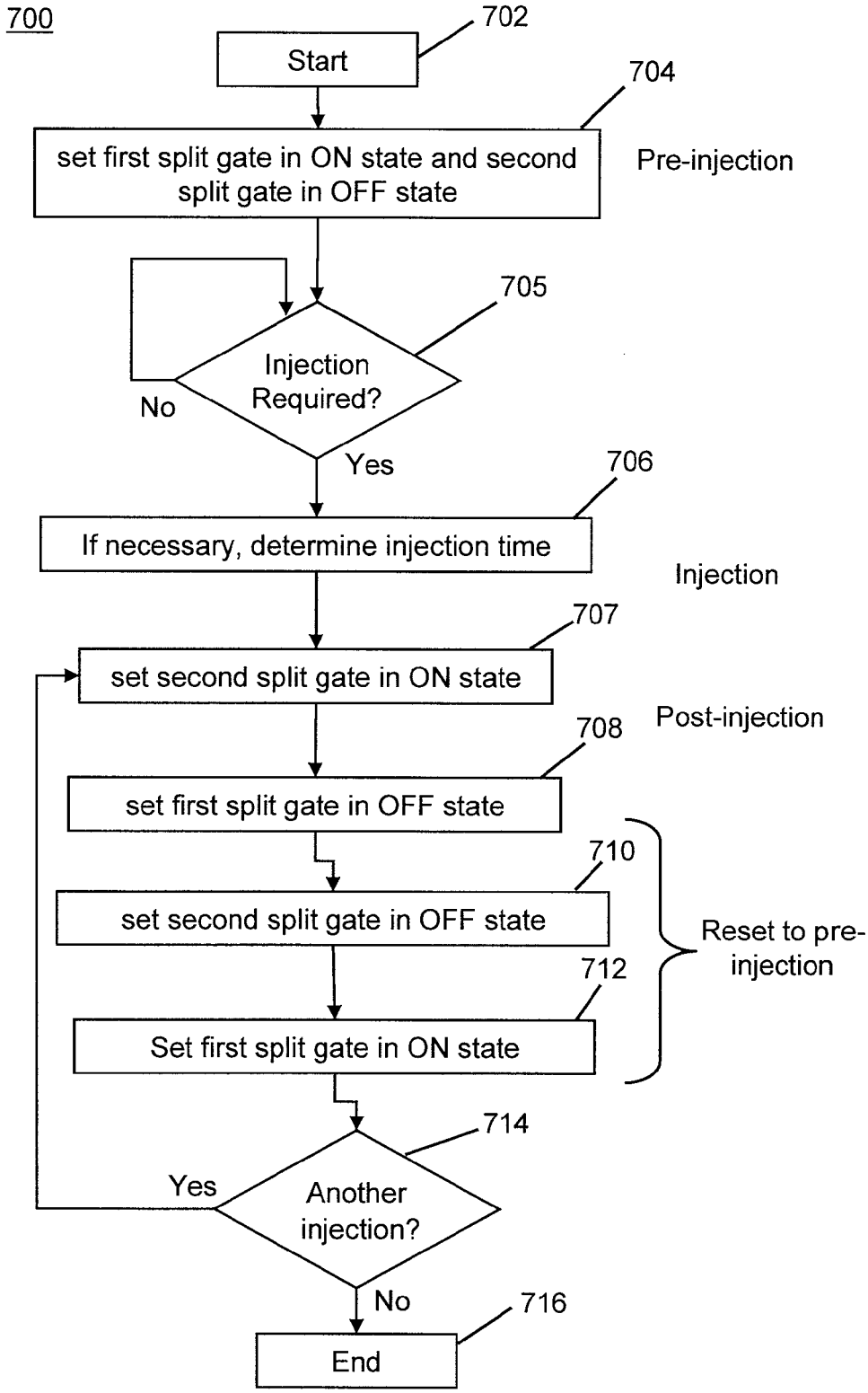
FIG. 7 is a flow chart depicting a method of operation of an ion gate apparatus in accordance with an embodiment of the present invention.

FIG. 6 is a graph of calculations of the total number of clean ions of two different species with different respective m/z values that pass through an ion gate in accordance with an embodiment of the present invention. The calculations illustrated in FIG. 6, were performed using the Simion® 3D Version 7.0 modeling software package, commercially available from Scientific Instrument Services, Inc. of Ringoes, N.J. USA. The "clean" ions are those that have not experienced a large modulation—that is, not more than about 1 electron volt (eV)—of the kinetic energy. Typical mass spectrometry trapping devices can only handle a kinetic energy spread of about 1 eV. Any ion that manages to pass through the gate, but has its kinetic energy changed by more than about 1 eV will appear to have never passed through the gate, since it can not be trapped. Such kinetic energy modulation will occur anytime change voltage of an ion optic is changes while an ion is within its "sphere of influence". FIG. 6 shows plots that are similar to those depicted in FIG. 2 with regards to a conventional ion gate apparatus and a comparison between the two graphs illustrates the reduction of transmission bias provided by the present invention at short injection times. Curve 605*a* in FIG. 7 represents the total number of ions having m/z equal to 100 that are detected plotted versus the injection time. Curve 605*b* is a similar plot representing the total number of ions having m/z equal to 1000 that are detected. Curve 608 is the ratio, $R_{1000/100}$, of the detected population of heavier-mass to lighter-mass ions, also plotted versus injection time. Curve 608 shows that the ratio $R_{1000/100}$ approaches unity at much shorter injection times in comparison to the conventional ion gate apparatus.

As may be seen from FIG. 6, an ion gate apparatus in accordance with the present invention is able to transmit ions having m/z equal to 1000 down to very short injections times of less than 2 microseconds or even 1 microsecond. This compares favorably to operation of the conventional ion gate apparatus (FIGS. 1A-1C), in which ions of this mass-to-charge are not transmitted through to the mass analyzer at all when the injection time decreases to about the flight time through the conventional split gate. Provided that ions of a certain mass-to-charge are transmitted through to and detected by the mass analyzer, a user may use a ratio curve (that is, a curve, such as the curve 608 of FIG. 6, representing the ratio transmitted ions of a first mass to transmitted ions of another mass) as a calibration curve to correct the detected ionic intensities back to their original relative abundances in a sample.

FIG. 7 is a flow chart depicting a method of operation of an ion gate apparatus in accordance with an embodiment of the present invention. The method 700 is initiated in step 702. This preliminary step 702 may include providing an ion gate apparatus that includes a first split gate and a second split gate adjacent to the first gate and separated from the first split gate by a gap as shown, for instance, in any in of FIGS. 3-4. The initiation step 702 may also include providing the ion gate apparatus within a mass spectrometer that includes an origin, at one side of the ion gate apparatus, for providing ions and a destination, at the opposite side of the apparatus, for receiving ions when the ion gate apparatus is in an ON state. The initiation step 702 may also include the setting of a predefined injection time.

After the initiation step, method 700 proceeds to the step 704, wherein the first split gate is set to its ON state and the second split gate is set to its OFF state. This places the ion gate apparatus in its pre-injection configuration as schematically illustrated in FIG. 5A. Subsequently in step 705, it is determined whether an ion injection is required in order to permit a pulse of ions to be transmitted through the gate, such as from an origin to a destination within a mass spectrometer. If an ion injection is required, the method 700 proceeds to step 706, wherein an injection time may be determined. Then, in step 707, the second split gate is set to its ON state, thereby placing the ion gate apparatus in its ON state, as schematically illustrated in FIG. 5B. Subsequently, to halt the ion injection, the first split gate is set in its OFF state in step 708. The method 700 proceeds such that the time period commencing when the second split gate is set to its ON state and ending when the first gate is set to its OFF state is substantially equal to the injection time. In steps 710 and 712, the second split gate is placed in its OFF state and the first split gate is placed in its ON state, respectively, to as to return the apparatus to its pre-injection condition in anticipation of another potential ion injection. In step 714, if another ion injection is required. If another ion injection is required, an injection time is determined and the method 700 returns to the step 707.

The discussion included in this application is intended to serve as a basic description. Although the present invention has been described in accordance with the various embodiments shown and described, one of ordinary skill in the art will readily recognize that there could be variations to the embodiments and those variations would be within the spirit and scope of the present invention. The reader should be aware that the specific discussion may not explicitly describe all embodiments possible; many alternatives are implicit. Accordingly, many modifications may be made by one of ordinary skill in the art without departing from the spirit, scope and essence of the invention. Neither the description nor the terminology is intended to limit the scope of the invention—the invention is defined only by the claims.

What is claimed is:

1. An ion gate apparatus for controlling the transmission of ion pulses between an origin and a destination, comprising:

a first split gate having a front end facing the origin and a back end opposite to the origin comprising:

a first electrode; and a second electrode separated from the first electrode so as to form a first aperture therebetween, the first aperture extending a length $L_1$ between the first split gate front and back ends;

a second split gate having a front end facing the origin and a back end opposite to the origin disposed adjacent to the first split gate at a distance d from the first split gate and comprising:

a third electrode portion; and a fourth electrode separated from the third electrode so as to form a second aperture therebetween, the second aperture extending a length $L_2$ between the second split gate front and back ends;

a first voltage source electrically connected to said first electrode and to said second electrode and operable to apply a variable voltage across said first and second electrodes;

a second voltage source electrically connected to said third electrode and to said fourth electrode and operable to apply a variable voltage across said third and fourth electrodes; and a controller electrically connected to said first voltage source and to said second voltage source, wherein $d<L_1$ and $d<L_2$.

2. The ion gate apparatus of claim 1, further comprising an ion lens disposed between said first split gate and said second split gate.

3. The ion gate apparatus of claim 2, further comprising a second ion lens disposed between said second split gate and said destination.

4. The ion gate apparatus of claim 1, further comprising an ion lens disposed between said second split gate and said destination.

5. The ion gate apparatus of claim 1, wherein said first split gate and said second split gate are related such that, in operation, the time of flight of ions of said pulses across the distance d is less than the time of flight of said ions across each of said first and second split gates.

6. The ion gate apparatus of claim 1, wherein said controller is operable so as to command said first voltage source to apply a sequence of voltages across said first and second electrodes and said second voltage source to apply a sequence of voltages across said third and fourth electrodes, said sequences being designed to control the timing and duration of said ion pulses.

7. The ion gate apparatus of claim 6, wherein said sequences are operable so as to minimize the loss of relatively heavier ions in said ion pulses.

8. The ion gate apparatus of claim 1, wherein said origin is an ionization source and said destination is a mass analyzer.

9. The ion gate apparatus of claim 1, wherein said first split gate and said second split gate are related such that, in operation, the ion gate apparatus outputs a pulse of an ion of a certain m/z ratio to said destination such that the time duration of said pulse is less than the time of flight of said certain ion across each of said first and second split gates.

10. A method for controlling the transmission of ion pulses between an origin and a destination, an ion beam path being defined between the origin and the destination, comprising the steps of:

providing an ion gate apparatus comprising:

a first split gate having a first aperture therein through which the ion beam path passes, said first aperture having a length $L_1$ defined substantially parallel to said ion beam path, said first split gate disposed between said origin and said destination and having an ON state, wherein ions are transmitted therethrough and an OFF state, wherein ions are not so transmitted; and a second split gate having a second aperture therein through which the ion beam path passes, said second aperture having a length $L_2$ defined substantially parallel to said ion beam path, said second split gate disposed between said first split gate and said destination at a distance d from said first split gate wherein $d<L_1$ and $d<L_2$ and having an ON state, wherein ions are transmitted therethrough and an OFF state, wherein ions are not so transmitted;

setting said first split gate in its ON state by setting a first voltage difference defined across said first aperture and said second split gate in its OFF state by setting a second voltage difference defined across said second aperture;

determining an injection time interval during which ions are to be transmitted;

setting said second split gate in its ON state by changing said second voltage difference; and setting said first split gate in its OFF state by changing said first voltage difference, wherein the time from the setting of the second split gate in its ON state until the time of the setting of the first split gate in its OFF state is substantially equal to said injection time interval.

11. The method of claim 10, further comprising the subsequent steps of:

setting said second split gate in its OFF state by changing said second voltage difference; and setting said first split gate in its ON state by changing said first voltage difference.

12. The method of claim 10, wherein said step of determining an injection time interval during which ions are to be transmitted comprises the steps of:

determining an optimal number of ions to be transmitted to said destination;

determining an ion flux from said origin; and calculating said injection time interval as the time required for said ion flux to deliver said optimal number of ions.

13. The method of claim 10, further comprising the step of either storing or mass analyzing said ion pulses in said destination.

14. The method of claim 10, wherein the injection time interval is determined so as to be less than the time of flight of ions of said ion pulses across each of said first and second split gates.

15. An ion gate apparatus for controlling the transmission of ion pulses between an origin and a destination, comprising:

a first split gate having a front end facing the origin and a back end opposite to the origin, comprising:

a first electrode; and a second electrode separated from the first electrode so as to form a first aperture therebetween, the aperture extending a length $L_1$ between the first split gate front and back ends;

a second split gate having a front end facing the origin and a back end opposite to the origin disposed adjacent to the first split gate at a distance d from the first split gate and comprising:

a third electrode; and a fourth electrode separated from the third electrode so as to form a second aperture therebetween, the second aperture extending a length $L_2$ between the second split gate front and back ends;

a first voltage source electrically connected to said first electrode and to said second electrode and operable to apply a variable voltage across said first and second electrodes;

a second voltage source electrically connected to said third electrode and to said fourth electrode and operable to apply a variable voltage across said third and fourth electrodes; and a controller electrically connected to said first voltage source and to said second voltage source, wherein an accelerating voltage is applied between said first and second split gates such that the time of flight of ions of said pulses across the distance d is less than the time of flight of said ions across each of said first and second split gates.

16. The ion gate apparatus of claim 15, further comprising an ion lens disposed between said first split gate and said second split gate.

17. The ion gate apparatus of claim 16, further comprising a second ion lens disposed between said second split gate and said destination.

18. The ion gate apparatus of claim 15, further comprising an ion lens disposed between said second split gate and said destination.

19. The ion gate apparatus of claim 15, wherein said controller is operable so as to command said first voltage source to apply a sequence of voltages across said first and second electrodes and said second voltage source to apply a sequence of voltages across said third and fourth electrodes, said sequences being designed to control the timing and duration of said ion pulses.

20. The ion gate apparatus of claim 19, wherein said sequences are operable so as to minimize the loss of relatively heavier ions in said ion pulses.

21. The ion gate apparatus of claim 15, wherein said origin is an ionization source and said destination is a mass analyzer.

22. The ion gate apparatus of claim 15, wherein said first split gate and said second split gate are related such that, in operation, the ion gate apparatus outputs a pulse of an ion of a certain m/z ratio to said destination such that the time duration of said pulse is less than the time of flight of said certain ion across each of said first and second split gates.

* * * * *